United States Patent [19]

Kitajima et al.

[11] Patent Number: 4,942,104

[45] Date of Patent: Jul. 17, 1990

[54] FLEXIBLE ELECTROPHOTOGRAPHIC PHOTOCONDUCTOR HAVING A POLYSULFONE CURL PREVENTION LAYER

[75] Inventors: Ryouichi Kitajima; Satoshi Otomura, both of Numazu, Japan

[73] Assignee: Ricoh Company, Ltd., Tokyo, Japan

[21] Appl. No.: 245,281

[22] Filed: Sep. 16, 1988

[30] Foreign Application Priority Data

Sep. 17, 1987 [JP] Japan ..... 62-232893

[51] Int. Cl.[5] ..... G03G 5/10

[52] U.S. Cl. ..... 430/56; 430/62; 430/531; 430/533; 430/930

[58] Field of Search ..... 430/56, 62, 531, 533, 430/930

[56] References Cited

U.S. PATENT DOCUMENTS 4,654,284 3/1987 Yu et al. ..... 430/531 X 4,740,439 4/1988 Tachikawa et al. ..... 430/56 X

OTHER PUBLICATIONS

Research Disclosure, Jun. 1978, Number 17041, Fewster, G. L. and Ruoff, J. S. *Photoconductive Element.*

Xerox Disclosure Journal, vol. 10, 1985, p. 55, Marsh B. B. Anti-Curl *Layer For Flexible Photoreceptor.*

*Primary Examiner*—Paul R. Michl

*Assistant Examiner*—Jeffrey A. Lindsman

*Attorney, Agent, or Firm*—Oblon, Spivak, McClelland, Maier & Neustadt

[57] ABSTRACT

An electrophotographic photoconductor is disclosed, which comprises a flexible film-type substrate, an electroconductive layer formed on a front surface of the substrate, a photoconductive layer formed on the electroconductive layer, and a curl prevention layer formed on the back side of the substrate opposite to the back side thereof, in which the curl prevention layer comprises one resin component selected from the group consisting of a polysulfone resin and a polyarylate resin.

6 Claims, No Drawings

FLEXIBLE ELECTROPHOTOGRAPHIC PHOTOCONDUCTOR HAVING A POLYSULFONE CURL PREVENTION LAYER

BACKGROUND OF THE INVENTION

The present invention relates to an electrophotographic photoconductor comprising a substrate, an electroconductive layer formed on the substrate, and a photoconductive layer formed on the electroconductive layer, with an improved curl prevention layer which is formed on the back side of the substrate opposite to the electroconductive layer with respect to the substrate, and more particularly to an electrophotographic photoconductor of the above-mentioned type, in which the curl prevention layer comprises a polysulfone resin or a polyarylate resin.

In the photoconductive layer of conventional electrophotographic photoconductors, inorganic photoconductive materials such as selenium, cadmium sulfide and zinc oxide are widely employed. These inorganic photoconductive materials have various shortcomings in spite of their advantages over other photoconductive materials.

For example, a selenium photoconductive layer has the shortcomings that its productivity is low and the manufacturing conditions are difficult because of the necessity for vacuum deposition of selenium when forming a selenium photoconductive layer, so that its production cost is high. In addition, selenium is remarkably susceptible to heat and mechanical shocks and has the problem that it is easily crystallized on some environmental conditions.

A cadmium sulfide photoconductive layer is easily affected by moisture and causes an environmental pollution problem unless the photoconductive layer is coated with an insulating layer.

A zinc oxide photoconductive layer has the problem that its photoconductive properties deteriorate by corona charging and exposure to light while in use, because it is sensitized with a relatively weak dye such as Rose Bengale. Furthermore, in the case of the zinc oxide photoconductive layer, since zinc oxide particles are dispersed in a resin, it is difficult to obtain a photoconductive layer with a surface having satisfactory smoothness, hardness and resistance to wear.

On the other hand, photoconductive layers containing organic photoconductive materials are more flexible, and easier to produce as compared with the above-mentioned inorganic photocondutive layers, so that a variety of organic photoconductors have been proposed as having the advantage that electrophotographic properties can be obtained at a lower cost when organic photoconductors are employed, as compared with the inorganic photoconductive materials.

Specific examples of photoconductors using organic photoconductive materials are: (1) a photoconductor in which an electron transfer complex is formed by the combination of an electron donor and an electron acceptor as disclosed, for instance, in U.S. Pat. No. 3,484,237; (2) a photoconductor in which an inorganic photoconductive material is sensitized by dyes as disclosed, for instance, in Japanese Patent Publication 48-25658; (3) photoconductors in which pigments are dispersed in a positive hole or electron active matrix as disclosed, for instance, in Japanese Laid-Open Patent Applications 47-30328 and 47-18545; (4) photoconductors comprising a charge generation layer and a charge transport layer, as disclosed, for instance, in Japanese Laid-Open Patent Application 49-105537; (5) a photoconductor comprising as the main component an eutectic crystal complex consisting of a dye and a resin, as disclosed, for instance, in Japanese Laid-Open Patent Application 47-10785; and (6) a photoconductor comprising a charge transporting complex to which an organic pigment or an inorganic charge generating material is added, as disclosed, for instance, in Japanese Laid-Open Patent Application 49-91648.

Among the above photoconductors, the function-separating type photoconductors (4) are used in practice, because there are many choices in the materials in accordance with the desired photosensitivity and functions.

The charge generation layer of the function-separating type photoconductor is prepared by dispersing a charge generating material such as azo pigments, phthalocyanine type pigments, indigo type pigments and perylene type pigments in a resin binder such as polyester, polycarbonate, polyvinyl butyral and an acrylic resin, and then coating the dispersion to a substrate.

The charge transport layer is usually prepared by (i) dissolving a charge transporting material, such as triphenylamine compounds, hydrazone compounds, α-phenylstilbene compounds and pyrazoline compounds, in an appropriate organic solvent, together with a binder resin such as polyester, polysulfone, polycarbonate, polymethacrylate esters, and polystyrene, to form a solution, and (ii) coating the solution, for instance, on a charge generation layer, and (iii) drying the same.

In such a function-separating photoconductor, a charge transport layer may be placed over a charge generation layer or thereunder. In addition, an undercoat layer (or an intermediate layer) and an overcoat layer may be provided in the photoconductor when necessary.

Hereinafter an electrophotographic photoconductor comprising an organic photoconductive material as the main component is referred to as the OPC (Organic Photoconductor).

When a flexible film, such as a polyethyleneterephthalate film, is used as a substrate of the OPC, an endless-belt-shaped photoconductor can be made. When such a flexible endless-belt-shaped photoconductor is incorporated in a copying machine, it has the advantage that the degree of freedom for the mechanical design of the layout of the copying machine is expanded, as compared with a rigid photoconductor.

Further, when the above endless-belt-shaped photoconductor is structured in such a manner that the photoconductor includes a flat portion, it has another advantage that it enables high-speed copying by use of flash exposure.

Furthermore, when both the substrate and an electroconductive layer formed thereon which serves as an electrode are made transparent, the photoconductor has the further advantage that the quenching of electric charges on the photoconductor can be effectively performed by exposing the back side of the substrate to light.

Besides the above-mentioned advantages, the OPC has the advantages that it is light-weight, suitable for mass production, and can be discarded without any problem after use.

However, an OPC belt has the shortcoming that it is easily curled. When the OPC belt is curled, the predetermined distances between the OPC belt and units surrounding the OPC, such as a charging unit and a development unit in the copying machine cannot be exactly maintained. When this takes place, there occur the problems that the charged potential of the photoconductor becomes uneven in the course of charging, exact focusing cannot be performed on the photoconductor at the step of exposure, with the result that toner particles are adversely deposited on the background of the images at the step of development.

Furthermore, if the edge portion of the OPC belt is curled when the OPC belt unit is mounted on the copying machine, the OPC belt may come into contact with the above-mentioned units such as a charging unit and a development unit so that the belt might be damaged by such contact. This may considerably shorten the life of the OPC belt.

As an attempt to solve the curling problem of the OPC belt, a method of providing a curl prevention layer is proposed. Such a curl prevention layer is disclosed, for instance, in Japanese Laid-Open Patent Application 62-100764, which comprises a film-forming binder, crystalline particles dispersed in the film-forming binder, a reaction product of a two-functional chemical binder agent and the film-forming binder, and another reaction product of the two-functional chemical binder agent and the crystalline particles. This curl prevention layer, however, has the shortcomings that the curl prevention layer peels off the substrate when used in a copying machine for a long period of time due to its weak adhesive force to the substrate, and the mounting of the photoconductor unit on the copying machine is not easy, so that its handling is difficult.

SUMMARY OF THE INVENTION

It is therefore an object of the present invention to provide a flexible electrophotographic photoconductor, in which a curl prevention layer does not peel off a substrate in the course of continuous practical use, and which photoconductor is superior in surface smoothness and handling characteristics, and convenient when mounted on a copying machine, thus from which the above-mentioned shortcomings of the conventional electrophotographic photoconductors have been eliminated.

The above object of the present invention is attained by use of a curl prevention layer containing a polysulfone resin or a polyarylate resin attached to the back side of a flexible film type substrate, on the front surface of which substrate, an electroconductive layer and a photoconductive layer, which may be a single-layer-type photoconductive layer or a multiple- layer-type photoconductive layer, are successively overlaid in this order.

DETAILED DESCRIPTION OF THE PREFERRED EMBODIMENTS

According to the present invention, in an electrophotographic photoconductor, a curl prevention layer containing at least a polysulfone resin or a polyarylate resin is provided on the back side of a substrate, opposite to a photoconductive layer formed on the substrate.

Generally, the curling of an electrophotographic photoconductor occurs because there is some difference in the degree of elongation or shrinkage between a flexible film-type substrate and a photoconductive layer after the formation of the photoconductive layer. This curling can be prevented by providing a curl prevention layer on the back side of the substrate, which curl prevention layer elongates or shrinks to the same extent as does the photoconductive layer formed on the substrate, opposite to the curl prevention layer. This means that the curl prevention layer is required to have the same degree of elongation or shrinkage as that of the photoconductive layer.

Furthermore, the above curl prevention layer is required to show a sufficient adhesive force to the substrate for practical use in a copying machine, when attached to the substrate directly.

Therefore, it is considered that such a curling problem may be solved by use of a curl prevention layer comprising as its component the same binder resin as that employed in the photoconductive layer. However, the binder resin employed in the photoconductive layer may not always have a sufficient adhesive force to the substrate for practical use in the copying machine. This is because the photoconductive layer is practically not in direct contact with the substrate, but an electroconductive layer or an undercoat (intermediate) layer is interposed between the substrate and the photoconductive layer.

In the present invention, with the above-mentioned points taken into consideration, an electrophotographic photoconductor capable of satisfying the above requirements is obtained by use of a curl prevention layer comprising as the main component a polysulfone resin or a polyarylate resin.

A preferable polysulfone resin for use in the present invention is comprised of the following repeating unit (I) or (II):

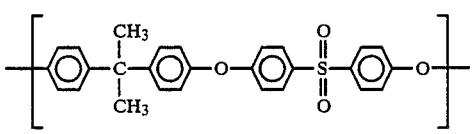

(I)

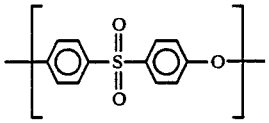

(II)

A preferable polyarylate resin for use in the present invention is comprised of the following repeating unit (III):

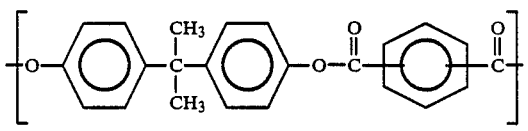

(III)

The curl prevention layer for use in the present invention can be prepared by coating the above polysulfone resin or polyarylate resin on the back side of the substrate and then drying it.

It is preferable that the thickness of the curl prevention layer be determined by the curling degree of the entire OPC belt. In other words, the greater the curling of the OPC belt, the thicker the curl prevention layer.

The thickness of the curl prevention layer is also changed depending on the type of a resin used therein. For example, when the same binder resin as that in the photoconductive layer is employed in the curl prevention layer, an appropriate thickness of the curl prevention layer can be calculated by the following formula:

$$y = \frac{a}{100} \times \alpha\ OPC$$

wherein y represents the thickness of a curl prevention layer; $\alpha$ OPC represents the thickness of a photoconductive layer; and a is the weight percentage of the binder resin in the photoconductive layer.

According to the present invention, the procedure for providing the curl prevention layer on the back side of the substrate is not limited to a particular procedure. The curl prevention layer may be provided on the back side of the substrate either before or after the photoconductive layer is provided on the opposite side of the substrate.

As the flexible substrate for use in the present invention, a sheet of an appropriate synthetic resin film is used. A particularly preferable substrate for use in the present invention is a sheet of polyethylene-terephthalate (PET) film.

Furthermore, for more firm fixing of the curl prevention layer to the substrate, it is preferable that the back side of the substrate be finished with a roughness of 0.1 $\mu$m to X $\mu$m (X represents the thickness of the substrate) in terms of the center line average roughness (Ra).

The above-mentioned roughness (Ra) of 0.1 $\mu m \leqq Ra < X\ \mu m$ can be formed on the substrate by the conventional surface treatment method, such as sandblast, filing, chemical treatment, low-temperature plasma treatment, and corona charging treatment, which are generally known. Alternatively, the desired roughness can be formed on the substrate surface by adding to a substrate a filler having definite particles.

Depending on the required adhesive force of the curl prevention layer, it is preferable that the above-mentioned surface roughness be determined. It is confirmed that a preferable adhesive force can be obtained for the curl prevention layer for use in the present invention when the surface roughness ranges from 0.1 $\mu$m to X $\mu$m in terms of the center line average roughness (Ra) as mentioned above, wherein X represents the thickness of the substrate on which the curl prevention layer is formed as mentioned previously.

According to the present invention, an electroconductive layer is provided on the surface of the substrate. A metallic thin film, made of a metal such as aluminum, nickel, chromium and titanium, or an alloy thin film made of any of the above-mentioned metals in combination, such as nichrome, Hastelloy, Inconel, and stainless, is preferable for use as the electroconductive layer. Transparent electroconductive materials may be employed for the electroconductive layer, which can be selected from metal oxides. The electroconductive layer can also be prepared by coating a carbonbased paint on a substrate.

As the photoconductive layer, a single-layer-type photoconductive layer and a multiple-layer-type photoconductive layer may be employed in the present invention. When the multiple-layer-type photoconductive layer is employed, the combination of a charge generation layer and a charge transport layer, which is widely known as a function-separating type photoconductive layer, is preferably employed in the present invention.

The above-mentioned charge generation layer comprises an organic charge generating material or the combination of an organic charge generating material and a binder resin.

Specific examples of the organic charge generating material for use in the charge generation are as follows: organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); an azo pigment having a carbazole skeleton (Japanese Laid-Open Patent Application 53-95033), an azo pigment having a distyryl benzene skeleton (Japanese Laid-Open Patent Application 53-133445), an azo pigment having a triphenylamine skeleton (Japanese Laid-Open Patent Application 53-132347), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), and an azo pigment having a distyryl carbazole skeleton (Japanese Laid-Open Patent Application 54-14967); a phthalocyanine pigment such as C.I. Pigment Blue 16 (C.I. 74100); indigo pigments such as C.I. Vat Brown 5 (C.I. 73410) and C.I. Vat Dye (C.I. 73030); perylene pigments such as Algol Scarlet B and Indanthrene Scarlet R (made by Bayer Co., Ltd.); a squaric pigment; and hexagonal selenium particles.

The charge generation layer can be formed, for example, as follows:

The above-mentioned charge generating material, with addition of a binder resin when necessary, is dispersed together with a solvent such as tetrahydrofuran, cyclohexanone, dioxane and dichloroethane in a ball mill, an attritor, or a sand mill, to prepare a dispersion of the charge generating material. This dispersion is coated on the substrate by a conventional coating method such as bead coating, nozzle coating, blade coating, dip coating, and spray coating, and then dried.

Specific examples of the above binder resin are polyamide, polyurethane, polyester, epoxy resin, polyketone, polycarbonate, silicone resin, acrylic resin, polyvinyl butyral, polyvinyl formal, polyvinyl ketone, polystyrene, poly-N-vinylcarbazole, and polyacrylamide.

The charge transport layer comprises as the main component a charge transporting material.

As the charge transporting material, compounds having a polycyclic aromatic compound such as anthracene, pyrene, phenanthrene, and coronene on the main chain or side chain thereof, or nitrogen-containing cyclic compounds such as indole, carbazole, oxazole, isoxazole, thiazole, imidazole, pyrazole, oxadiazole, pyrazoline, thiadiazole, and triazole; a triphenylamine compound; a hydrazone compound as disclosed in Japanese Laid-Open Patent Application 55-46760; and an $\alpha$-phenyl stilbene compound as disclosed in Japanese Laid-Open Patent Application 58-198043 may be employed.

The above-mentioned charge transporting materials are dissolved in a solvent such as tetrahydrofuran, cyclohexanone, dioxane, and dichloroethane, with addition of a thermoplastic or thermosetting resin to prepare a charge transport layer coating liquid. The thus prepared charge transport layer coating liquid is coated by bead coating, nozzle coating, dip coating or spray coating and then dried, so that a charge transport layer is prepared. It is preferable that the thickness of the charge transport layer be in the range of 5 μm to 50 μm, more preferably in the range of 15 μm to 35 μm.

Examples of the above-mentioned thermoplastic or thermosetting resin for the charge transport layer coating liquid are polystyrene, styrene - acrylonitrile copolymer, styrene - butadiene copolymer, styrene - maleic anhydride copolymer, polyester, polyvinyl chloride, vinyl chloride -vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl - formal, polyvinyl toluene, poly-N-vinylcarbazole, acrylic resin, silicone resin, epoxy resin, melamine resin, urethane resin, phenolic resin, and alkyd resin.

In addition, an undercoat layer (intermediate layer) may be interposed between the electroconductive layer and the photoconductive layer, when necessary.

When an undercoat layer is provided, the same binder resins as those employed in the charge generation layer can be employed for the undercoat layer. Furthermore, a white pigment such as titanium oxide, a sulfonic acid or alkali metal salt thereof, and an anionic electrically-conductive polymer such as an ammonium salt can be blended as an additive in the binder resin. It is preferable that the above additives be not soluble in the solvent which is used to prepare the coating liquid for the layer laminated on the undercoat layer.

An overcoat layer may be provided on the upmost layer when necessary.

The present invention will now be explained in detail with reference to the following examples, which are given for illustration of the invention and are not intended to be limiting thereof.

EXAMPLE 1

[Preparation of Curl Prevention Layer]

1,000 parts by weight of a polysulfone resin (Trademark "P-3500" made by Nissan Chemical Industries, Ltd.) were dissolved in 9,000 parts by weight of tetrahydrofuran to prepare a curl prevention layer coating liquid. The thus prepared curl prevention layer coating liquid was coated on a polyethylene-terephthalate film serving as a substrate (hereinafter referred to as the PET film), having a thickness of 100 μm and then dried, whereby a curl prevention layer having a thickness of 13 μm was formed on the PET film.

[Preparation of Electroconductive Layer]

On the opposite side to the curl prevention layer of the PET film, an aluminum-deposited electroconductive layer having a thickness of about 1000 Å was formed by vacuum deposition.

[Preparation of Undercoat Layer]

240 parts by weight of an alcohol-soluble copolymer nylon (Trademark "CM-8000" made by Toray Silicone Co., Ltd.) were dissolved in a mixture of 3,000 parts by weight of methanol and 300 parts by weight of butanol to prepare an undercoat layer coating liquid. The thus prepared undercoat layer coating liquid was coated on the above-prepared electroconductive layer by bead coating and then dried, whereby an undercoat layer having a thickness of about 1 μm was formed on the electroconductive layer.

[Preparation of Charge Generation Layer]

A mixture of the following components was kneaded and dispersed in a ball mill for 72 hours.

| | Parts by Weight |
|---|---|
| Compound (I) having the following formula: 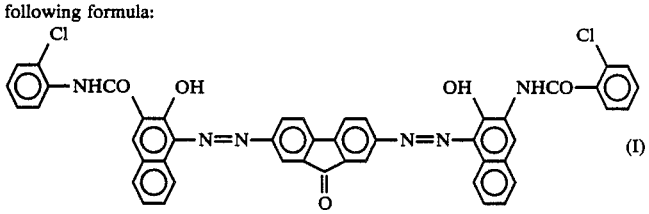 | 13.5 |
| Polyvinyl butyral resin (Trademark "XYHL" made by Union Carbide Japan K.K.) | 5.4 |
| Tetrahydrofuran | 360.0 |

The thus prepared mixture was further dispersed and kneaded with addition of 211 parts by weight of tetrahydrofuran and 356 parts by weight of ethylene glycol monoethyl ether for 1 hour. This dispersion was diluted with a mixture of 110 parts by weight of tetrahydrofuran and 664 parts by weight of ethylene glycol monoethyl ether to prepare a charge generation layer coating liquid.

The thus prepared charge generation layer coating liquid was coated on the undercoat layer by bead coating and then dried, whereby a charge generation layer having a thickness of about 0.5 μm was formed.

[Preparation of Charge Transport Layer]

935 parts by weight of compound (II) having the following formula and 1,039 parts by weight of a polycarbonate resin (Trademark "Panlite C-1400" made by Teijin Limited) were dissolved in 7,900 parts by weight of tetrahydrafuran. To this solution, 2 parts by weight of 1%-tetrahydrofuran solution of silicon oil (Trademark "KF-50" made by Shin-Etsu Chemical Co., Ltd.) were added to prepare a charge transport layer coating liquid.

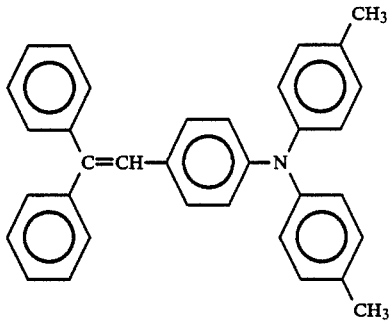

(II)

The thus prepared charge transport layer coating liquid was coated on the above-prepared charge generation layer by nozzle coating and then dried, whereby a charge transport layer having a thickness of about 25 μm was formed.

Thus, a electrophotographic photoconductor No. 1 according to the present invention was prepared.

EXAMPLE 2

Example 1 was repeated except that the polysulfone resin in the formulation of the curl prevention layer coating liquid in Example 1 was replaced by a polyarylate resin (Trademark "U-4015" made by Unitika Ltd.) and that the thickness of the curl prevention layer was changed to 10 μm, whereby an electrophotographic photoconductor No. 2 according to the present invention was prepared.

COMPARATIVE EXAMPLE 1

Example 1 was repeated except that the polysulfone resin in the formulation of the curl prevention layer coating liquid in Example 1 was replaced by polycarbonate resin, whereby a comparative electrophotographic photoconductor No. 1 was prepared.

COMPARATIVE EXAMPLE 2

Example 1 was repeated except that the curl prevention layer was not formed on one side of the polyethyleneterephthalate film, whereby a comparative electrophotographic photoconductor No. 2 was prepared.

The electrophotographic photoconductors No. 1 and No. 2 according to the present invention and the comparative electrophotographic photoconductors No. 1 and No. 2 were checked with respect to the curling degree thereof and the adhesive force of the curl prevention layer to the substrate by the following method.

To measure the curling degree, each photoconductor was cut in a predetermined size. The thus obtained piece of the photoconductor was placed on a standard plate and the curling degree was measured by a height gauge.

The adhesive force of the curl prevention layer to the substrate was measured by subjecting each photoconductor to a peeling test by use of an adhesive cellophane tape. The results are shown in Table 1.

TABLE 1

| | Curling Degree | Adhesive Force to Substrate |
|---|---|---|
| Example 1 | o | o |
| Example 2 | o | o |
| Comparative | o | x |

TABLE 1-continued

| | Curling Degree | Adhesive Force to Substrate |
|---|---|---|
| Example 1 Comparative Example 2 | x | — |

The mark "o" shows the level on which the photoconductor has no problem for practical use in a copying machine.
The mark "x" shows the level on which the photoconductor is required to improve.

What is claimed is:

1. An electrophotographic photoconductor comprising a flexible film-type substrate, an electroconductive layer formed on a front surface of said substrate, a photoconductive layer formed on said electroconductive layer, and a curl prevention layer formed on the backside of said substrate, opposite to said front surface of said substrate, which curl prevention layer consists essentially of a resin component selected from the group consisting of a resin having a repeating unit of formula (I) and a resin having a repeating unit of formula (II):

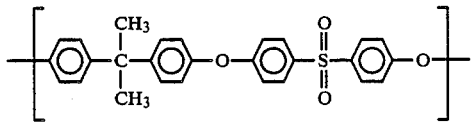

(I)

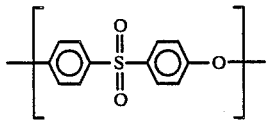

(II)

2. The electrophotographic photoconductor as claimed in claim 1, wherein said polysulfone resin in said curl prevention layer comprises a repeating unit of formula (I):

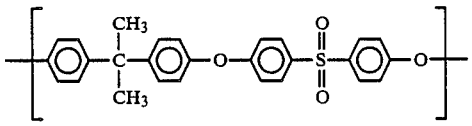

(I)

3. The electrophotographic photoconductor as claimed in claim 1, wherein said polysulfone resin in said curl prevention layer comprises a repeating unit of formula (II):

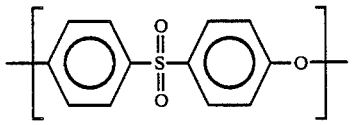

(II)

4. The electrophotographic photoconductor as claimed in claim 1, wherein said photoconductive layer comprises a charge generation layer and a charge transport layer.

5. The electrophotographic photoconductor as claimed in claim 1, wherein said flexible film-type substrate is made of polyethylene terephtharate.

6. The electrophotographic photoconductor as claimed in claim 1, wherein the back side of said substrate has a roughness of 0.1 μm to X μm in terms of center line average roughness, in which X represents the thickness of said substrate.

* * * * *

UNITED STATES PATENT AND TRADEMARK OFFICE

CERTIFICATE OF CORRECTION

PATENT NO. : 4,942,104

DATED : JULY 17, 1990

INVENTOR(S) : Ryouichi KITAJIMA et al

It is certified that error appears in the above-identified patent and that said Letters Patent is hereby corrected as shown below:

Column 1, line 50, "photocondutive" should read -- photoconductive --;

line 61, "an inorganic" should read -- an organic --.

Signed and Sealed this

Seventh Day of April, 1992

*Attest:*

HARRY F. MANBECK, JR.

*Attesting Officer*

*Commissioner of Patents and Trademarks*